United States Patent [19]

Wakeman et al.

[11] 4,073,605

[45] Feb. 14, 1978

[54] ROTARY PUMP CONSTRUCTION WITH CLEANING FEATURE

[75] Inventors: Alden H. Wakeman, Lake Mills; Leonard R. Heiliger, Fort Atkinson, both of Wis.

[73] Assignee: Crepaco, Inc., Chicago, Ill.

[21] Appl. No.: 723,456

[22] Filed: Sept. 15, 1976

[51] Int. Cl.[2] ..... F04B 49/08; F04C 29/00

[52] U.S. Cl. ..... 417/283; 417/310; 418/133; 418/134

[58] Field of Search ..... 418/131, 133, 134, 181, 418/270; 417/283, 310

[56] References Cited

U.S. PATENT DOCUMENTS

| | | | |
|---|---|---|---|
| 1,475,683 | 11/1923 | Carrey | 418/131 X |
| 1,694,805 | 12/1928 | Wiltse | 418/133 |
| 2,642,001 | 6/1953 | Dale et al. | 418/133 |
| 2,786,553 | 3/1957 | Boone et al. | 418/131 X |
| 2,848,952 | 8/1958 | Wakeman | 418/75 |
| 3,162,140 | 12/1964 | Petit | 418/133 X |
| 3,876,349 | 4/1975 | Svensson | 418/181 X |

*Primary Examiner*—Carlton R. Croyle
*Assistant Examiner*—Leonard Smith
*Attorney, Agent, or Firm*—Neuman, Williams, Anderson & Olson

[57] ABSTRACT

A positive fluid pump is provided which is capable of being cleaned in place by a circulating cleaning solution without the various pump components being disassembled. The impellers for the pump are rotatably mounted within a chamber formed in a housing. The inlet and the outlet for the chamber are separated from one another by the engaging impellers during normal operation of the pump. One of the side walls forming the pump chamber is provided with a cavity in which is slidably and sealingly mounted a wall piece. Under normal operation of the pump, the wall piece assumes a first position wherein one surface thereof is disposed adjacent the corresponding end faces of the impellers. When, the pump is being cleaned in place, the wall piece assumes a second position independently of the impellers wherein the one surface thereof is recessed from the pump chamber and the inlet and the outlet are interconnected permitting the cleaning solution to circulate through the chamber and around the impellers. The wall piece is retained in the first position by a predetermined pneumatic pressure exerted on a second surface of said wall piece disposed opposite said one surface. The predetermined pneumatic pressure is released when the pump is to be cleaned in place, allowing the wall piece to be moved to the second position by the circulating cleaning solution.

9 Claims, 7 Drawing Figures

ROTARY PUMP CONSTRUCTION WITH CLEANING FEATURE

BACKGROUND OF THE INVENTION

The use of a pump particularly in the handling of food and dairy products has always been subjected to stringent sanitary regulations and as a result thereof the pump must be capable of withstanding repeated and thorough washing cycles wherein strong and/or high temperature cleaning solutions are utilized. Heretofore in order to meet such regulations the pumps were designed so that they could readily be disassembled. Such a capability, however, involved a time consuming, awkward, and frustrating manual operation. With the introduction of the clean-in-place concept, partial disassembly of the group was oftentimes still required, and/or in certain instances the pump was required to be of complex and costly construction. Furthermore, because of the high temperatures to which the pump components were normally subjected during the cleaning cycle, certain of the components would expand or swell thereby causing excessive wear to occur during the cleaning cycle, or when the pump would run dry prior to the fluid reaching the pump from a remote location, or in some instances when the pump resumed its pumping operation. In still other instances, during the clean-in-place cycle, the pump produced a substantial pressure drop within the line in which the pump was connected thereby adversely affecting proper cleaning of other equipment connected in the line.

SUMMARY OF THE INVENTION

Thus, it is an object of the invention to provide a positive fluid pump which meets the various stringent sanitary regulations and, yet, may be cleaned in place without requiring even partial disassembly of the pump components or the expenditure of manual labor.

It is a further object of the invention to provide a positive fluid pump which, when in the clean-in-place cycle, produces a minimal pressure drop within the line similar to that which might otherwise occur if the impellers were removed from the pump chamber.

It is a still further object of the invention to provide a positive fluid pump wherein the wear life of the various moving components thereof is prolonged notwithstanding that such components are frequently subjected to very high temperatures causing thermal expansion thereof.

It is a still further object of the invention to provide a positive fluid pump wherein the impellers thereof, during the clean-in-place cycle, are free to move axially away from the side walls of the pump chamber and thus enable the pump chamber and impellers to be more effectively cleaned without being disassembled.

It is also a further object of the invention to provide a positive fluid pump which may utilize a general service, clean low pneumatic pressure source normally available within a plant where the pump is installed.

Further and additional objects will appear from the description, accompanying drawings, and appended claims.

In accordance with one embodiment of the invention, a positive fluid pump is provided which includes a housing having formed therein a pump chamber, and an inlet and an outlet therefor. Rotatably mounted within the chamber and separating the inlet and the outlet during normal pumping operation is a pair of impellers. The pump chamber is defined in part by a pair of side walls, one of which has a cavity formed therein and a wall piece sealingly and slidably mounted within the cavity for movement between first and second positions. When the wall piece is in the first position, one surface thereof is disposed closely adjacent the corresponding end faces of the impellers. When in the second position, however, the wall piece is retracted into the side wall cavity and recessed from the pump chamber, thereby enabling the impellers to move freely relative to the pump chamber side walls. The wall piece is retained in the first position by a predetermined pneumatic pressure exerted on a second surface of the wall piece during the pumping cycle. When the pump is being cleaned in place the pneumatic pressure is relieved thereby enabling the wall piece to readily move to the second position in response to the pressure of the cleaning solution circulating through the pump chamber.

DESCRIPTION

For a more complete understanding of the invention reference should be made to drawings wherein.

Figure 1:
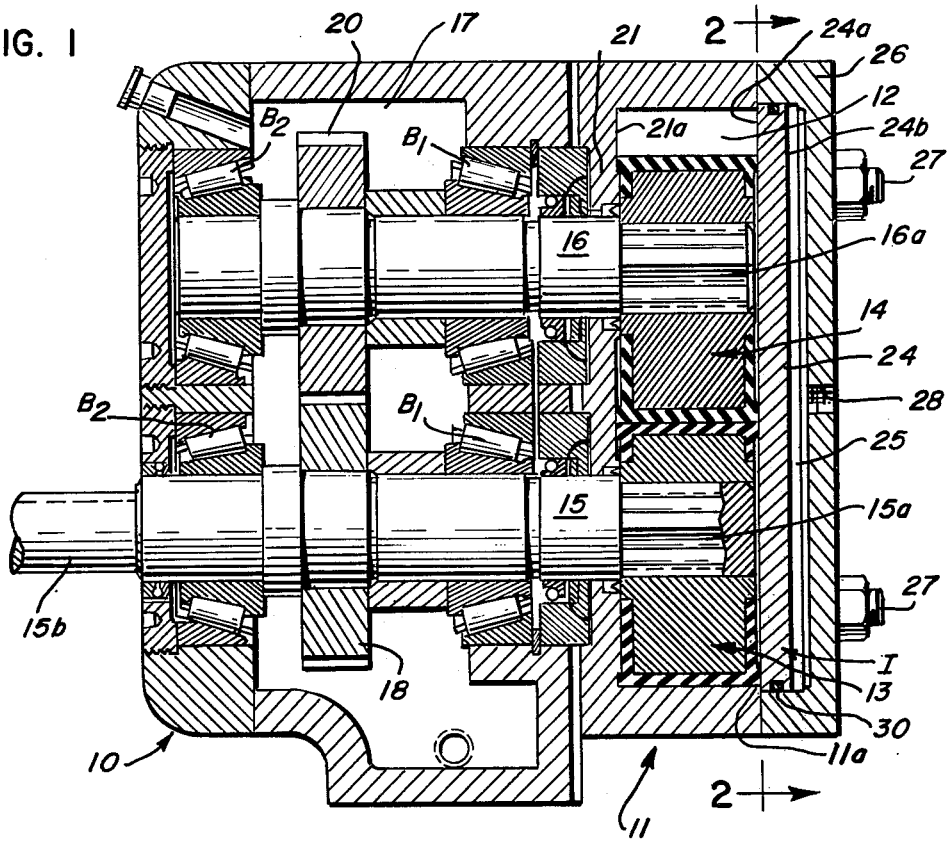
FIG. 1 is a vertical sectional view of one form of the improved positive fluid pump in condition for a normal pumping cycle.

For a more complete understanding of the invention reference should be made to FIG. 1 wherein a preferred form of the improved positive fluid pump 10 is shown in vertical section. Pump 10 by way of example may embody certain of the structural features of the pump disclosed in U.S. Pat. No. 2,848,952 as will hereinafter be discussed. Pump 10 is particularly suitable for use in pumping fluids wherein the latter are susceptible to contamination and thus, require the pump components to be subjected to frequent and thorough cleaning or sterilization. Furthermore, such a pump is oftentimes subjected to rinsing where different flavored or composition fluids are to be successively pumped therethrough or is subjected to periodic air blow-down to remove completely a liquid fluid from the system which incorporates the subject pump.

Heretofore in order to attain the proper cleaning of such components, it was oftentimes necessary to subject the pump to substantial disassembly which was a difficult, costly and time-consuming manual operation. In an effort to minimize the problem associated with such a manual operation, the clean-in-place concept was widely adopted; however, notwithstanding the adoption of this concept, partial disassembly of certain of the components still persisted in many instances; in other instances elaborate, costly and complex structural features were incorporated in the pumps; and in still other instances excessive wear of certain of the components was experienced due to thermal expansion thereof. The improved pump 10 readily overcomes these problems by modifying primarily the pump housing 11 in which the pump chamber 12 is formed. In pump 10, shown in FIG. 1, the chamber 12 accommodates therein a pair of meshing impellers 13 and 14 which are mounted on the splined ends 15*a*, 16*a* of shafts 15, 16, the latter being supported within the housing by suitable bearings $B_1$ and $B_2$. Shaft 15 has the opposite end 15*b* thereof projecting from the housing and connected by conventional means to a drive motor or the like, not shown. Disposed within a compartment 17 formed in the housing interior are a pair of meshing gears 18, 20 which are keyed to shafts 15 and 16, respectively. Thus, through the gears 18, 20 both of the impellers 13, 14 are positively driven by a single source of power.

Compartment 17 and one pair of shaft bearings $B_1$ are separated from pump chamber 12 by a partition 21 which has one surface 21*a* thereof functioning as one side wall of the chamber 12.

Figure 2:
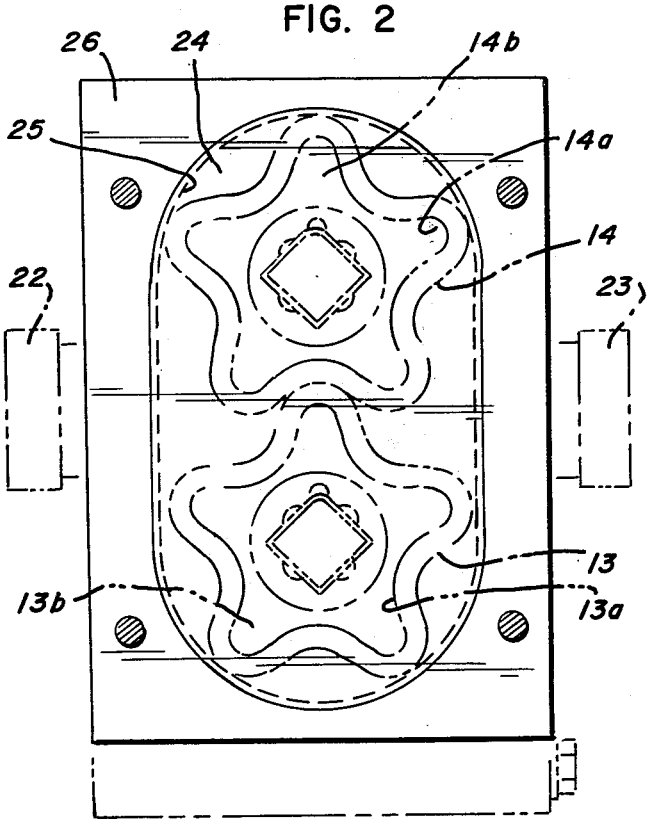
FIG. 2 is a fragmentary sectional view taken along line 2—2 of FIG. 1 and showing the impellers, the inlet, and the outlet phantom lines.

An inlet port 22 and an outlet port 23, both shown in phantom lines in FIG. 2, are formed in the housing 11 and communicate with the pump chamber 12. During a normal pumping cycle, the inlet and outlet are separated from one another by the rotating impellers 13, 14. There is little, or no leakage, of the fluid around the impellers during the pumping cycle. Furthermore, if desired, the end faces of the impellers may be provided with peripheral bosses 13*a*, 14*a* delimiting end face cavities 13*b*, 14*b* which are in communication with the outlet side of the pump chamber 12 and cause the cavities to be filled with high pressure fluid and thus, provide lubrication and pressurize the shaft seal. The aforeidentified U.S. Pat. No. 2,848,952 discloses in detail the structural features for accomplishing this result.

The impellers are normally the components of the pump which are most susceptible to thermal expansion which unless compensated for will produce a serious wear problem. It is this problem which is effectively overcome in the improved pump as will become apparent from the description hereinafter.

The opposite side wall of chamber 12 is defined by an inflexible wall piece 24 which is slidably mounted within a cavity 25 formed in a cover plate 26 which is secured by suitable fasteners 27 to the exterior of the housing 11. The wall piece 24 is adapted to move between a first position I, see FIG. 1, and a second position II, see FIG. 2A. When the wall piece is in position I, one surface 24*a* thereof is in close proximity to the corresponding end faces of the impellers and is slidably engaged by the peripheral bosses 13*a*, 14*a* formed on the end faces. When the wall piece is in position I the periphery of surface 24*a* abuts a shoulder 11*a* formed in the interior of the housing 11.

The wall piece 24 is retained in position I during the normal pumping cycle by predetermined pneumatic pressure which is exerted against a second surface 24*b* of the piece. The pneumatic pressure may be introduced into cavity 25 through a suitable port 28 formed in cover plate 26. The amount of pneumatic pressure required to retain wall piece 24 in close proximity to the corresponding end faces of the impellers will depend upon the amount of fluid pressure generated within the pump chamber 12 while the impellers 13 and 14 are rotating at the desired speed. The compressed air utilized for this purpose may be clean air under a pressure (e.g. 60–75 psi) which is normally available in plants or facilities for general use.

To prevent leakage of the compressed air around the periphery of wall piece 24 and into chamber 12, a suitable seal 30 (e.g. an "O" ring) is provided which is carried within a suitable groove formed in the peripheral exterior of the piece. The seal 30 while preventing air as well as product leakage, also enables the piece 24 to slidably move within cavity 25.

Figure 2A:
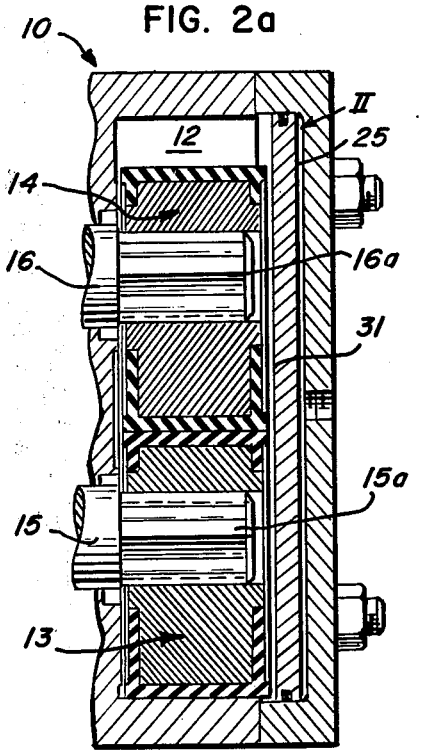
FIG. 2A is an enlarged fragmentary vertical sectional view similar to FIG. 1 but showing the pump chamber and the impellers in condition for a clean-in-place cycle.

When the wall piece 24 is in position II, as seen in FIG. 2A, it is recessed relative to chamber 12 and the surface 24*b* thereof is in contact with or adjacent to the rear of cavity 25. To enable the wall piece to move to position II, the pneumatic pressure exerted thereon to retain the piece in position I is relieved by means of a suitable valve, not shown, disposed within the line connected to port 28. The pressure is relieved only when the pump is in the clean-in-place cycle at which time a cleaning solution is circulated through the system including the pump 10. When the cleaning solution is being circulated through the pump 10, the impellers 13 and 14 are not driven by the drive means utilized during the pumping cycle. The circulating cleaning solution will exert a pressure on surface 24*a* of wall piece 24 thereby causing the latter to automatically move from position I to position II. Because of the wall piece being recessed from the pump chamber 12, a bypass 31 is formed, see FIG. 2A, which allows the cleaning solution to readily flow from the inlet to the outlet through the pump chamber and the bypass. Simultaneously with the circulation of the cleaning solution through the pump chamber and bypass, the impellers 13 and 14 are free to move axially along the shaft splined ends 15*a*, 16*a* into a portion of the bypass thereby enabling the cleaning solution to flow past the opposite end faces of the impellers.

Figure 3:
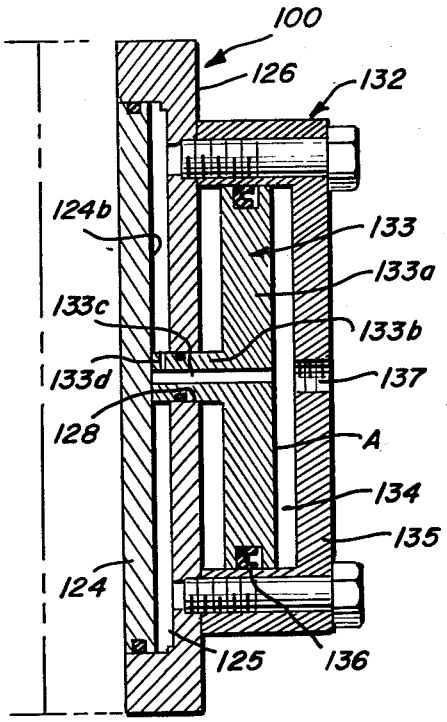
FIG. 3 is an enlarged fragmentary vertical sectional view of a first modified form of pump chamber side wall provided with a cavity having a wall piece and booster piston disposed therein; the wall piece and booster piston being shown in positions they assume during a normal pumping cycle.
Figure 5:
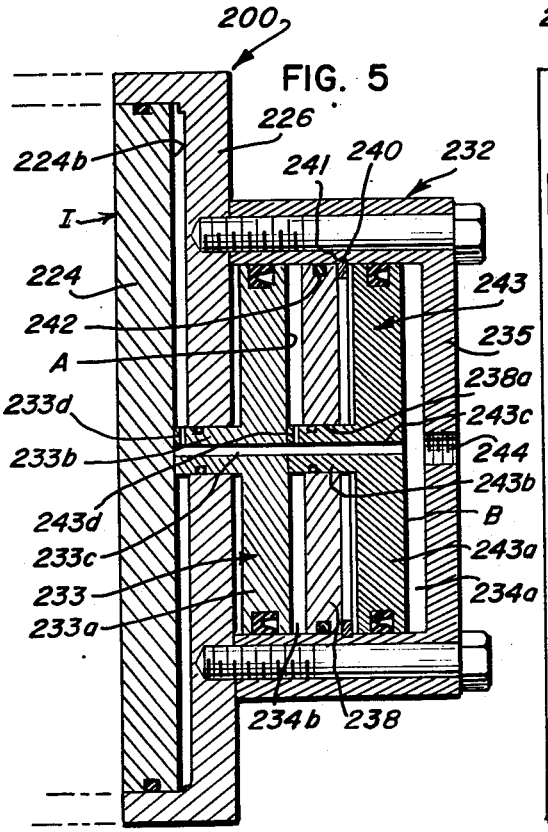
FIG. 5 is similar to FIG. 3 but showing a second modified form of group chamber side wall.

To return the pump 10 to a normal pumping cycle merely requires shutting off the circulating cleaning solution, and exerting the necessary pneumatic pressure against surface 24*b* whereupon the wall piece will automatically move to position I. Simultaneously with the movement of the wall piece to position I, the impellers will be engaged by the wall piece surface 24*a* and cause the impellers to resume their proper relative positions within the pump chamber 12, that is to say, when the end faces of the impellers are in close proximity to the side walls of the pump chamber. The amount of pressure exerted on the impeller end faces by the wall piece can be regulated so as to compensate for any swelling or enlargement of the impellers due to their exposure to the high temperature cleaning solution. Thus, excessive wear of the impellers can be readily controlled.

Where the pneumatic pressure available at the pump is insufficient to retain the wall piece in position I during a normal pumping cycle, a pressure boosting means may be utilized. Two modified pump constructions 100 and 200 are shown in FIGS. 3 and 5, respectively. Pump constructions 100 and 200 differ from pump 10 in the inclusion of booster assemblies 132, 232 which are secured to the exterior of the cover plate 126, 226.

Booster assembly 132, as seen more clearly in FIG. 3, includes a booster piston 133 having an enlarged head portion 133*a* and a central stem portion 133*b* extending transversely in one direction from the head portion. The head portion 133*a* is mounted for sliding and sealing engagement within a second cavity 134 formed in supplemental cover plate 135 and disposed in aligned relation with the cavity 125 formed in cover plate 126. Cover plates 26 and 126 are of like construction except that in place of port 28 serving as a connection to the source of the pneumatic pressure, an opening 128 is formed in cover plate 126 which slidably accommodates the stem portion 133*b* of the booster piston 133.

An axial bore 133*c* is formed in the stem and head portions of the booster piston 133. At the distal end of stem portion 133*b* there is formed a transverse port 133*d* which communicates at one end at bore 133*c* and at the other end with the exterior of the stem portion 133*b* and also with the cavity 125 formed in cover plate 126. The periphery of the head portion of piston 133 carries a seal 136 which slidably engages the wall surfaces of cavity 134. Supplemental cover piece 135 is provided with a port 137 which is connected to a source of pneumatic pressure, not shown. Thus, upon pneumatic pressure being introduced into cavity 134 through port 137, force will be exerted on the surface A of head portion 133*a* urging the piston to move to the left, or towards cover plate 126. Such motion is transmitted to wall piece 124 through the stem portion 133*b*. Simultaneously with the application of the pneumatic pressure on the head portion surface A, the same pneumatic pressure is exerted on the surface 124*b* of the wall piece 124 via bore 133*c* and port 133*b*. The extent to which the force exerted upon the wall piece 124 is increased to retain same in position I will depend upon the area of piston surface A.

Figure 4:
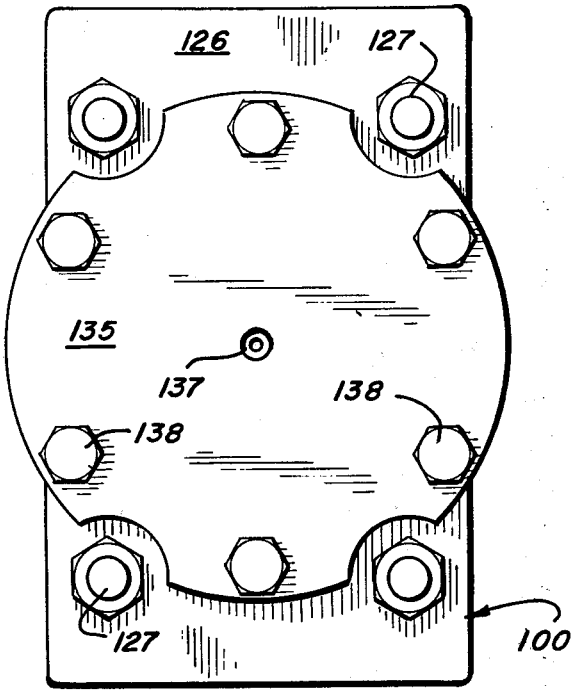
FIG. 4 is an enlarged fragmentary side elevational view of the exterior of the side wall shown in FIG. 3.

As seen in FIGS. 3 and 4, the supplemental cover plate 135 is fixedly secured to the exterior of cover plate 126 by a plurality of symmetrically arranged fasteners 138. Cover plate 126, in turn, is secured to the pump housing by fasteners 127.

Figure 6:
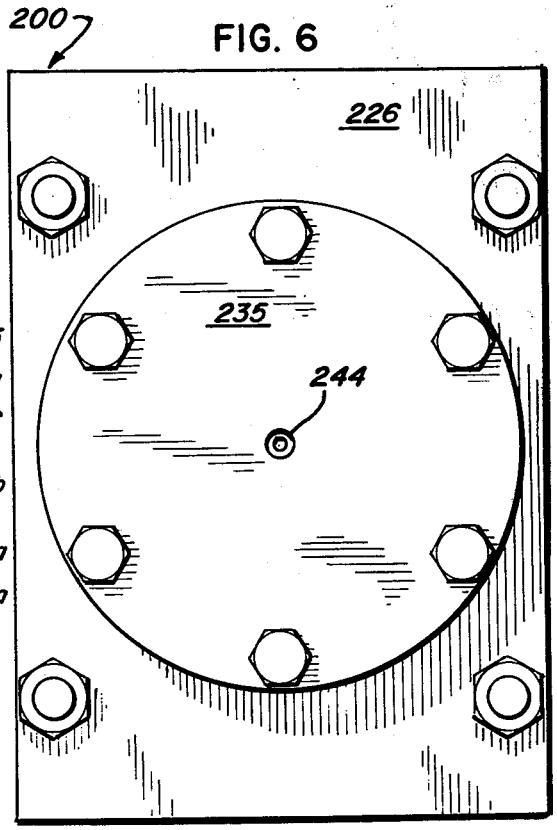
FIG. 6 is similar to FIG. 4 but of the exterior of the side wall shown in FIG. 5.

FIGS. 5 and 6 illustrate a pump 200 wherein boosting of the force exerted on the wall piece 224 is increased over that attainable in pump 100. Pump 200 utilizes a booster assembly 232 embodying a supplemental cover plate 235 having a cavity formed therein which is divided into two separate sections 234*a* and 234*b* by a partition member 238. The partition member is held in place within the cavity by a conventional snap ring 240, encompassing the partition member and resiliently engaging a groove 241 formed in the cavity wall. In addition to the snap ring, partition member 238 is embraced by a seal 242, such as an "O" ring.

The partition member is provided with a central opening 238*a* in which is slidably disposed the stem portion 243*b* extending transversely in one direction from an enlarged head portion 243*a*. Portions 243*a*, 243*b* form a first booster piston 243 in which the head portion 243*a* is slidingly and sealingly mounted within cavity section 234*a*. Piston 243 is provided with a central bore 243*c* and a transversely extending port 243*d* which are similar to the corresponding bore and port of the booster piston 133 of assembly 132.

Disposed within cavity section 234*b* is a second booster piston 233 which is of the same construction as piston 133 of assembly 132. In the illustrated embodiment of the pump 200, the size and configuration of booster pistons 233 and 243 are the same. The center bores 233*c* and 243*c* are aligned with one another. The transverse port 243*d* formed in stem portion 243*b* of the piston 243 communicates with the portion of cavity section 234*b* which is defined by partition member 238 and surface A of head portion 233*a* of piston 233.

Compressed air is introduced into cavity section 234*a* through a port 244 formed in the rear wall of cover plate 235. The compressed air exerts a predetermined force on surface B of head portion 243*a*. The force generated by the application of the pneumatic pressure on surface B is transmitted to piston 233 through the engagement of the stem portion 243*b* and head portion 233*a*. At the same time by way of bore 243*c* and port 243*d* pneumatic pressure is exerted on surface A of piston 233 and this force is transmitted to the wall piece 224 through stem portion 233*b*. Also because of the alignment of bores 233*c*, 243*c* pneumatic pressure is transmitted to surface 224*b* of the wall piece 224 through transverse port 233*d* which boosts the force already exerted on the wall piece by piston stem portion 233*b*. Thus, with the booster assembly 232 of pump 200, the total force exerted on wall piece 224 is the sum of (*a*) the force exerted by piston 243 on piston 233 due to the application of pneumatic pressure on piston surface B, (*b*) the force exerted by piston 233 on the wall piece due to the application of pneumatic pressure on piston surface A, and (c) the force due to the application of pneumatic pressure on surface 224*b* of the wall piece 224. To attain with a given pneumatic pressure even greater boosting of the force exerted on the wall piece 224, the areas of surfaces A and B can be enlarged or the number of booster pistons increased. As aforementioned, the amount of force required to retain the wall piece in position I depends upon the amount of pump pressure developed within the pump chamber during normal pumping operation.

While movement of the wall piece to position II has been described in connection with the clean-in-place cycle, it may serve other purposes as well; for example, (a) if an unexpected pressure buildup or surge should accidentally occur within the pump chamber, such pressure will automatically be relieved by the wall piece moving away from position I due to the abnormal pressure differential created on the wall piece; (b) it facilitates rinsing the pump chamber prior to flavor or composition changes being made in the pumped fluid; and (c) it facilitates air blown-down of the pump when the pumped fluid is being removed from the system which incorporates the pump.

The description heretofore has been directed towards the use of the improved pump for handling food and dairy products; however, it is to be understood of course that its use is not limited thereto. The improved pump is capable of general use and desirable because only minimum servicing and maintenance is required, and its pumping capacity may be varied over a wide range without requiring any significant structural changes. The improved pump is versatile, of simple construction, and highly efficient in operation.

The size and configuration of the various components of the improved pump may vary from that shown without departing from the scope of the invention.

We claim:

1. A positive fluid pump comprising a housing having formed therein a pump chamber and an outlet and an inlet relatively spaced with respect to one another and communicating with said chamber, said chamber being provided with a pair of opposed side walls, one side wall having a portion thereof in sealing engagement therewith and movable relative to the other side wall between first and second positions; impellers engaging one another and rotatably mounted within said chamber and separating the inlet from the outlet when said wall portion is disposed in said first position and adjacent corresponding impeller end faces, said side wall portion being movable independently of said impellers and, when in said second position, being recessed from said pump chamber and forming therewith a sealed fluid by-pass communicating with said chamber and interconnecting said inlet and outlet, said impellers being axially movable independently of one another and the chamber side walls when said side wall portion assumes said second position; and selectively actuated means communicating with said side wall portion and when actuated to a first selected condition, effecting retention of the side wall portion in said first position and, when actuated to a second selected condition, enabling the side wall portion to be movable from said first position to said second position, said actuated means being sealed from the pump chamber by said side wall portion.

2. The positive fluid pump of claim 1 wherein the side wall portion is retained in said first position by predetermined pneumatic pressure and, when the actuated means is in a second selected condition, said side wall portion is responsive to fluid pressure with the pump chamber and moves from said first position to said second position.

3. The positive fluid pump of claim 1 wherein said impellers are mounted on a pair of spaced substantially parallel shafts extending from the other of said side walls into said pump chamber, one of said shafts being driven, said impellers being axially adjustable relative to said shafts when said side wall portion is disposed in said second position.

4. A positive fluid pump adapted to be cleaned in place with a circulating cleaning solution, said pump comprising a housing having formed therein a pump chamber and an outlet and an inlet spaced relative to one another and communicating with said chamber, said chamber being provided with a pair of opposed side walls disposed in substantially parallel relation, one side wall having a cavity formed therein in communication with said pump chamber, said one side wall including a wall piece disposed in sliding sealing engagement within said cavity and movable relative thereto between first and second positions; a pair of rotatably mounted shaft supported impellers disposed within said pump chamber, said impellers having the peripheries thereof engaging one another and separating the inlet from the outlet when the wall piece is disposed in said first position adjacent the corresponding end faces of said impellers; and means sealed from the pump chamber by said wall piece and communicating with cavity and, when actuated to a first condition, effecting retention of said wall piece in said first position whereby rotation of the impellers effects pumping of a fluid and, when said means is actuated to a second condition, enabling said wall piece to be movable from said first position to said second position wherein said wall piece is recessed from said pump chamber and forms a fluid by-pass communicating with said pump chamber, said means being actuated to said second condition when a cleaning solution is circulated through the housing whereby said impellers ar responsive to the circulating cleaning solution and adjust axially of the supporting shafts independently of one another and the chamber side walls.

5. The positive fluid pump of claim 4 wherein the wall piece is retained in said first position by predetermined pneumatic pressure and, when the actuated means is in said second condition, said wall piece is responsive to the pressure within the pump chamber and moves from said first position to said second position.

6. The positive fluid pump of claim 5 wherein the wall piece is inflexible and has one planar surface disposed adjacent said impellers and an opposite second surface exposed to said predetermined pneumatic pressure, the periphery of said wall piece being in sliding sealing engagement with the cavity wall surface.

7. The positive fluid pump of claim 6 wherein the one planar surface of said wall piece abuts a stationary shoulder when said wall piece is disposed in said first position.

8. The positive fluid pump of claim 7 wherein said housing includes a second cavity separated from the first mentioned cavity by an inflexible partition having an opening formed therein interconnecting said cavities; and a pneumatically responsive booster piston movably mounted in said second cavity, said piston being in sliding sealing relation with the second cavity surface and having an elongated stem projecting from a first surface of said piston, said stem being disposed in sliding sealing relation within said partition opening, said piston stem having a distal end engaging the second surface of said wall piece, said piston being provided with a first passageway extending therethrough and longitudinally of said stem, and a second passageway formed in said stem adjacent said distal end and effecting communication between said first passageway and the portion of said first mentioned cavity adjacent the second surface of said wall piece; and means for exposing a second surface of said booster piston to a predetermined pneumatic pressure.

9. The positive fluid pump of claim 8 wherein the area of the second surface of said wall piece is greater than the area of the piston second surface.

* * * * *

UNITED STATES PATENT AND TRADEMARK OFFICE

CERTIFICATE OF CORRECTION

PATENT NO. : 4,073,605

DATED : February 14, 1978

INVENTOR(S) : Alden H. Wakeman and Leonard R. Heiliger

It is certified that error appears in the above-identified patent and that said Letters Patent are hereby corrected as shown below:

Column 1, line 17 - "group" should be --pump--

Column 2, line 28 - Insert --in-- before "phantom"

line 41 - "group" should be --pump-- line 64 - "problem" should be --problems--

Column 5, line 14 - "surfaces" should be --surface-- line 26 - "133b" should be --133d--

Column 6, line 40 - "blown-down" should be --blow-down-- line 66, Claim 1 - Insert --side-- before "wall"

Column 7, line 49, Claim 4 - Insert --said-- before "cavity"

Column 8, line 8, Claim 4 - "ar" should be --are--

Signed and Sealed this

*Thirtieth* Day of *May 1978*

[SEAL]

*Attest:*

RUTH C. MASON
*Attesting Officer*

LUTRELLE F. PARKER
*Acting Commissioner of Patents and Trademarks*